US005376959A

United States Patent [19]

Rall

[11] Patent Number: 5,376,959

[45] Date of Patent: Dec. 27, 1994

[54] SPRAY PAINTER WITH REMOVABLE SUPPLY CRADLE

[75] Inventor: Rainer Rall, Winnisquam, N.H.

[73] Assignee: Vutek Inc., Meredith, N.H.

[21] Appl. No.: 868,544

[22] Filed: Apr. 14, 1992

[51] Int. Cl.[5] ..... B41J 15/00

[52] U.S. Cl. ..... 347/104; 242/595.1; 347/3

[58] Field of Search ..... 346/136, 134, 145, 140 R; 101/228; 400/613; 242/68.7, 78.7, 67.1, 67.2, 67.3; B41J 11/00; B65H 16/02, 18/02; 347/101, 104, 2, 3

[56] References Cited

U.S. PATENT DOCUMENTS

| | | | |
|---|---|---|---|
| 4,823,147 | 4/1989 | Charoppin | 346/136 |
| 4,914,522 | 4/1990 | Duffield et al. | 346/140 R X |
| 4,999,651 | 3/1991 | Duffield et al. | 346/140 R |
| 5,172,871 | 12/1992 | Schütt et al. | 242/68.7 X |
| 5,209,418 | 5/1993 | Alexander | 242/68.7 X |

FOREIGN PATENT DOCUMENTS

| | | | |
|---|---|---|---|
| 2024884 | 1/1980 | United Kingdom | B65H 16/02 |

*Primary Examiner*—Joseph W. Hartary
*Assistant Examiner*—Alrick Bobb
*Attorney, Agent, or Firm*—E. T. Barrett

[57] ABSTRACT

A printing system for the reproduction of large scale images by spray painting on a wide flexible medium such as vinyl or paper. A movable cradle is provided with a series of spaced endless belts that provide lateral support for the roll of medium to be painted or imprinted. The endless belts are in turn rotatably supported by a frame of sufficient strength to prevent significant bending of the structure. The belts are mounted on low-friction rollers that permit the medium roll to rotate as material is drawn from the roll into the painting system. The direction of material withdrawal is substantially vertical so that the roll remains in its controlled position as the size of the roll becomes smaller and to facilitate printing on either surface of the medium. The cradle is mounted on casters so that it can be readily moved into the frame of the painting system and locked in position. Because there is no removable axial support for the roll of medium, less space is required for the necessary manipulation of the medium.

9 Claims, 3 Drawing Sheets

SPRAY PAINTER WITH REMOVABLE SUPPLY CRADLE

BACKGROUND OF THE INVENTION

1. Field of the Invention

This invention relates to spray painting systems and more particularly to such a system incorporating a removable supply cradle for supporting long rolls of printing medium and feeding the medium into the painter.

2. Description of Related Art

Various devices are in use for supporting rolls of printing medium while it is being fed into a spray painting system. One usual practice is to support the medium roll on a shaft extending through the center of the supply roll. Such an arrangement is satisfactory for rolls of relatively narrow width or which are of light weight. However, with large rolls of heavy material, such as vinyl, the supporting structure may not have sufficient mass to prevent bending of the material along its lateral axis resulting in distortion of the image being reproduced by the spray painting system. Moreover, the need for expensive equipment for the handling of large and heavy rolls of material is eliminated by the use of a movable cradle that permits rotation of the supply roll with minimum friction.

SUMMARY OF THE INVENTION

A movable cradle is provided with a series of spaced endless belts that provide lateral support for the supply roll of medium to be painted or imprinted. The endless belts are in turn rotatably supported by a frame of sufficient strength to prevent significant bending of the structure. The belts are mounted on low-friction rollers that permit the supply roll to rotate as material is drawn from the roll into the painting system. The direction of material withdrawal is substantially vertical so that the roll remains in its controlled position as the size of the roll becomes smaller. The cradle is mounted on casters so that it can be readily moved into the painting system and locked in position. Because there is no removable axial support for the supply roll, less space is required for the necessary manipulation of the medium.

DESCRIPTION OF THE PREFERRED EMBODIMENT

Figure 1:
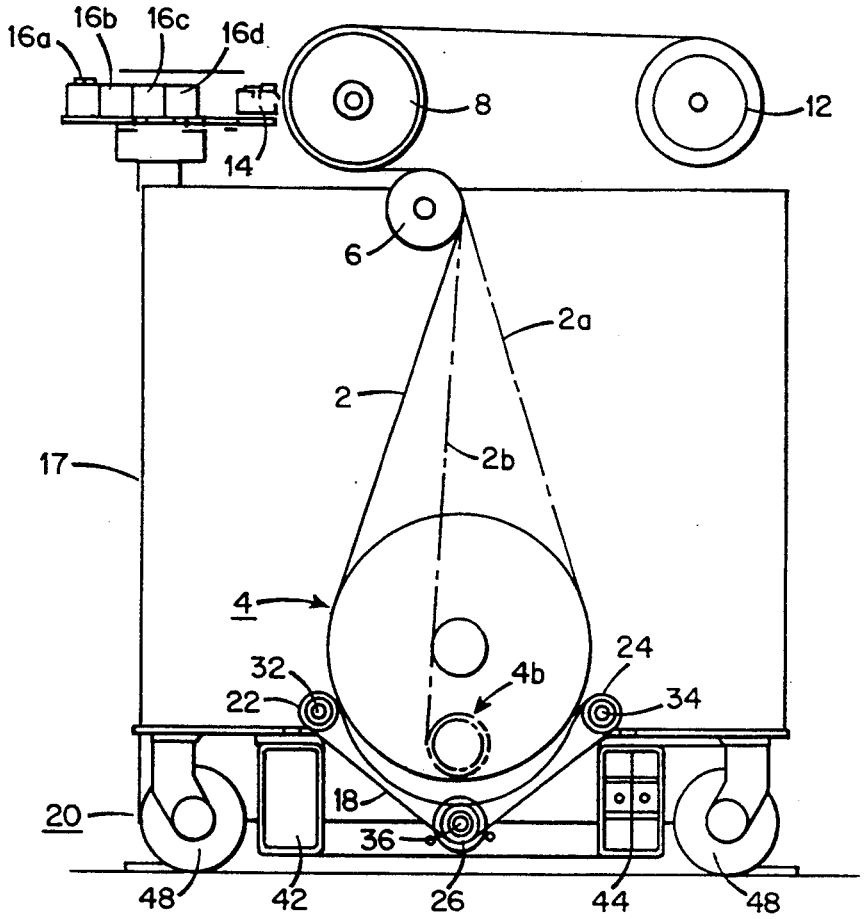
FIG. 1 is a diagrammatic end view of a spray painting system with a medium supporting cradle in position.
Figure 4:
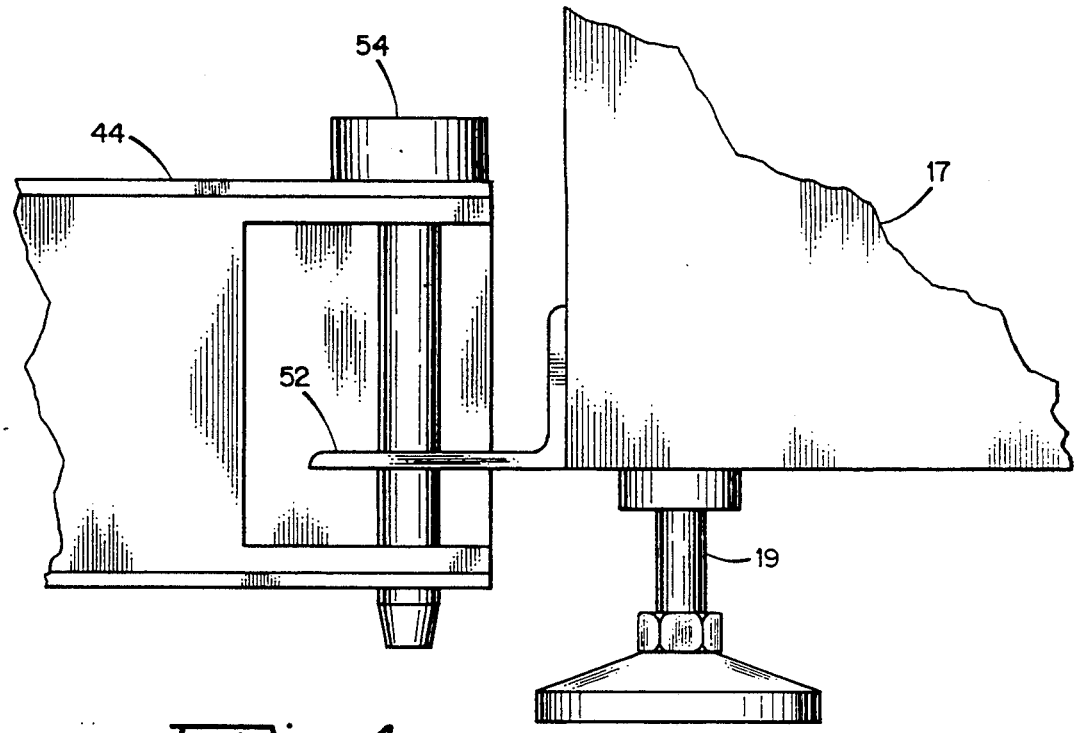
FIG. 4 is a partial section through the mechanism for locking the cradle to the printing frame.

As shown in FIG. 1, a length of printing medium 2, such as paper or vinyl, extends from a supply roll, generally indicated at 4, around a redirect roller 6 and a printing platen 8 to a take-up roller 12. A number of horizontally spaced spray jets, diagrammatically indicated at 14, are arranged to spray colored ink from ink supplier containers 16*a*, 16*b*, 16*c*, and 16*d*, respectively, onto the surface of the medium as it passes over the platen roller 8. As the ink jets scan horizontally, while the medium 2 is maintained in fixed position, the flow of ink from the jets is controlled in accordance with the image to be reproduced. At the completion of each scanning movement, the medium is advanced toward the take up roller 12 by one line. The ink jets 14 and rollers 6, 8 and 12, together with other parts of the printing system, are supported on a printer frame, diagrammatically indicated at 17 in FIG. 1 that is in turn mounted on any suitable support, such as four or more stanchions as illustrated at 19 in FIG. 4. The printing mechanism may be such as that described in U.S. Pat. Nos. 4,914,522 titled "Reproduction and Enlarging Imaging System Using a Pulse-width Modulated Air Stream", and 4,999,651 titled "Multicolor Recorder with Plural Ink Jets and Reservoirs Co-Mounted on a Reciprocating Carriage, Each Reservoir Containing a Sub-Reservoir in Communication with an Ink Supply Conduit".

Figure 2:
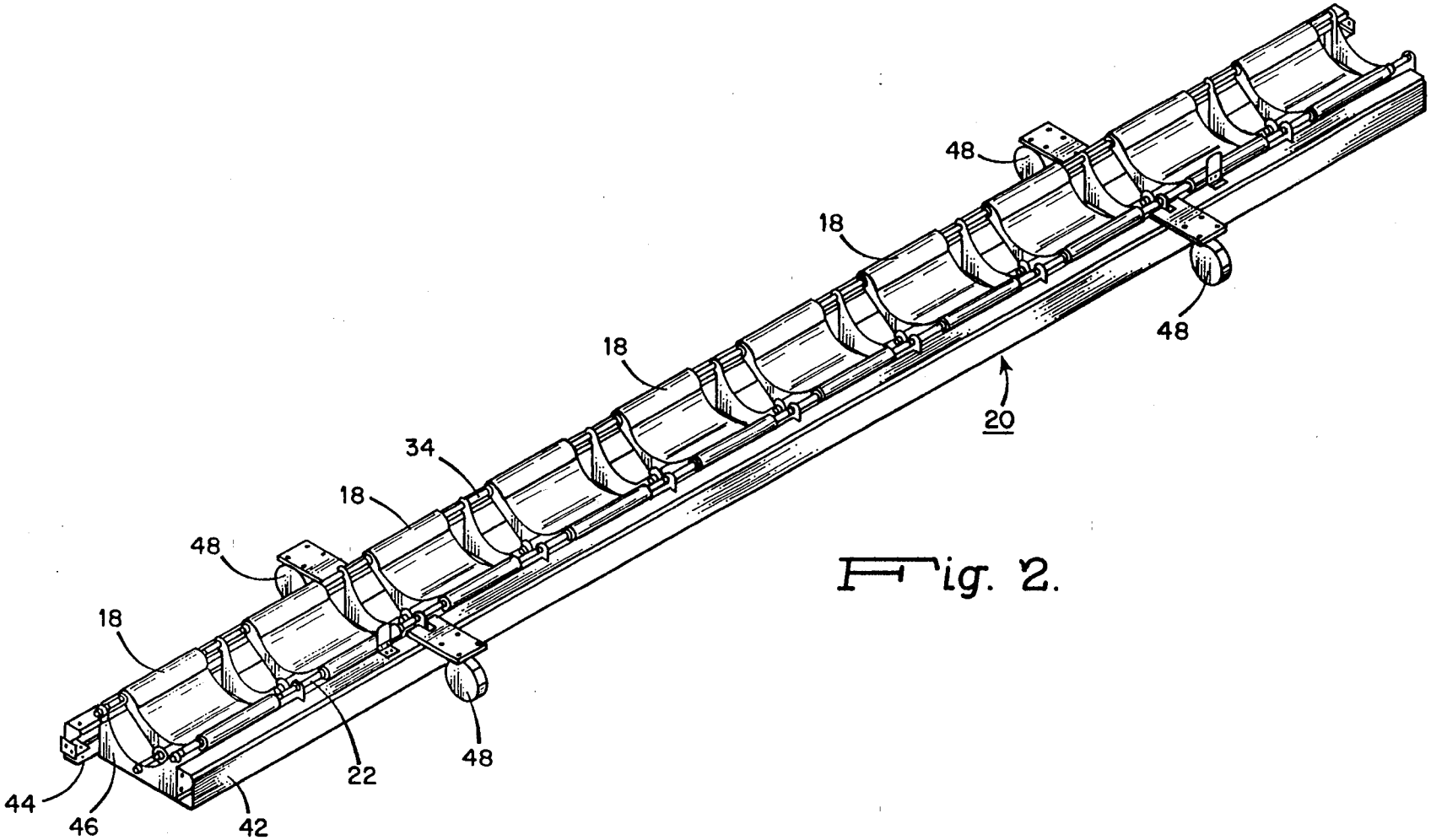
FIG. 2 is a perspective view of the removable cradle.

In a cradle, generally indicated at 20, the supply roll 4 is supported on a series of laterally spaced endless belts 18 (see also FIG. 2). Each belt 18 passes around and is supported by a front roller 22, a rear roller 24 and a bottom roller 26. The number of belts depends upon the width of the particular printing system. For a printer capable of handling media in sixteen foot widths, there should be between 8 and 12 belts, each between 8 and 14 inches in width. The preferred maximum spacing between adjacent belts is between 6 and 10 inches. For example, a practical sixteen foot printer system has 10 belts each 11 inches wide with a space of 8 inches between adjacent belts.

Figure 3:
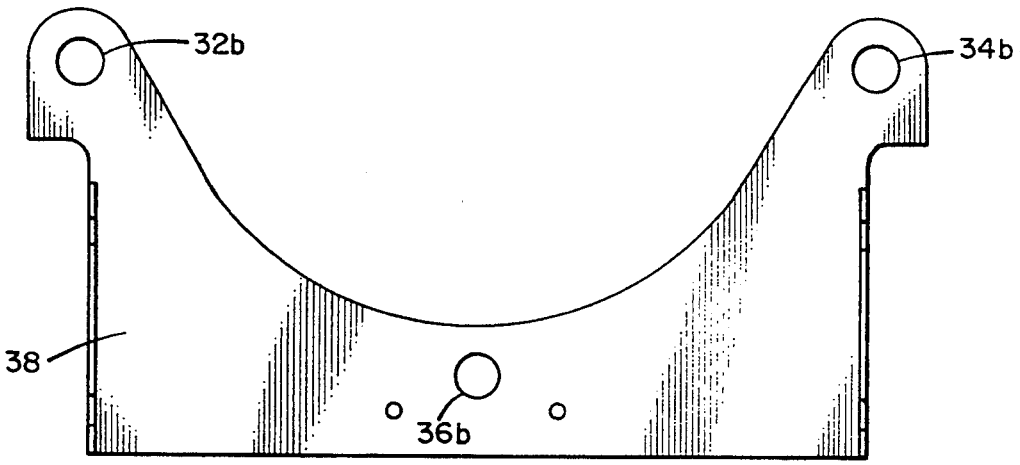
FIG. 3 is an elevational view of one of the spacer elements for supporting and positioning the cradle rollers.

The front rollers 22 are mounted on a horizontal support shaft 32 that extends the full length of the cradle. The rear rollers 24 are mounted on a similar horizontal shaft 34, and the bottom rollers 26 are mounted on a shaft 36. Each of these shafts is supported by a series of spacers 38 (FIG. 3) formed of sheet metal with bearing openings 32*b*, 34*b* and 36*b* that support-low friction bearings for the respective shafts. It is important that the rollers 22, 24 and 26 be free to rotate with minimum friction to permit the printing medium to be withdrawn from the supply roll with minimum force. Each of the spacers is secured to and supported by a front girder 42 (FIGS. 1 and 2) and a rear girder 44 that extend the length of the cradle and are maintained in relative position by a frame spacer sheet 46. The girders 42 and 44 are of sufficient strength to prevent any significant bending from the weight of the supply roll 4. The girders 42 and 44 together with the frame spacer 46 form the cradle frame.

Figure 5:
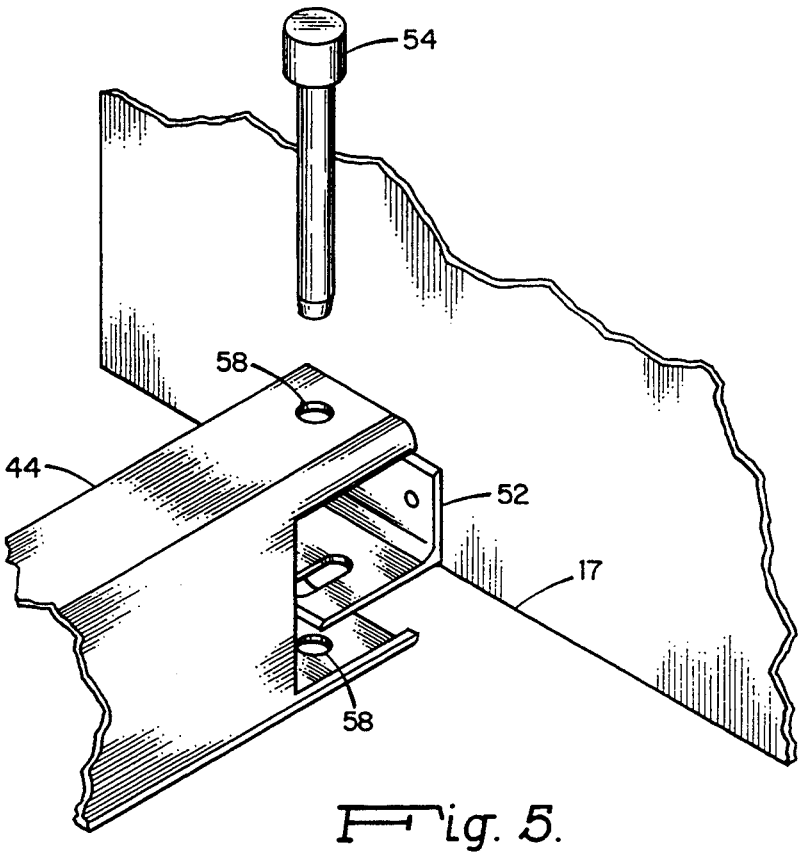
FIG. 5 is a perspective view from the rear of the end portion of a frame girder for securing the removable cradle to the frame of the spray painting mechanism.

In use, the supply roll 4 is placed on the belts 18 of the cradle 20 which is then moved into the front of the printer frame 17. To permit movement of the cradle 20, it is mounted on four casters 48 that are secured to and support the cradle frame. After the roll 4 is positioned on the cradle, the cradle is rolled into the printer frame 17 until movement is blocked by a pair of hitch members 52 (see also FIGS. 4 and 5) that extend inwardly from the printer frame 17 at opposite ends of the cradle 20. A section of the rear wall of the frame girder 44 is open at each end to permit the cradle to move past the hitch members until the inside of the front wall of the girder 44 strikes the hitch members. In this position a hitch pin 54 is inserted into an opening 56 in the top of the girder 44, through a hole in the hitch member 52 and into an opening 58 in the bottom wall of the girder 44.

An identical arrangement locks the opposite end of the cradle to the printer frame.

The center of the supply roll 4 is positioned near a vertical plane through the center of the re-direct roller 6 (FIG. 1), and is preferably not more than about 12 inches from that plane. This arrangement minimizes the force required to withdraw the printing medium from the supply roll and minimizes any tendency of the roll to climb on the belts 18. This positioning also facilitates printing on either side of the medium 2, that is, the medium can be withdrawn from the roll 4 along the path indicated at 2 in FIG. 1, or the roll may be reversed end-for-end on the cradle and the medium withdrawn along the line indicated at 2*a* in FIG. 1. The line 2*b* indicates the path of the material when the diameter of the supply roll is reduced as indicated at 4*b*. As the supply roll 4*b* becomes smaller, there may be some tendency for the roll to climb on the belts 18 and even to escape from the cradle. To guard against such an event, a pair of stops 58 (FIG. 2) are secured to the girder 42 and extend upwardly to block excessive movement of the supply roll.

It is important that the belts 18 each support an equal portion of the load of the supply roll 4 and, for that reason, the belts are formed of reinforced plastic or fabric and are pre-stretched to an identical length before being incorporated in the cradle structure.

I claim:

1. In a spray painting system for the reproduction of images on a flexible medium having a plurality of computer-controlled spray jets and scanning means for causing said spray jets to scan a lateral path across said medium, a combination comprising a roll of said flexible medium on which an image is to be produced, said roll having a longitudinal axis.

a printer frame, means for supporting said spray jets on said printer frame, drive means for withdrawing said medium from said roll and moving said medium in a direction transverse to said lateral path of said jets, and a cradle removably connected to said printer frame for supporting said roll of medium comprising a cradle frame extending in a direction parallel with said lateral path of said jets, a plurality of endless belts of flexible material, means for supporting said belts in a spaced relationship along a transverse center line parallel with said lateral path of said jets, and rotatable means mounted on said cradle frame for supporting said belts for movement in a plane perpendicular to said longitudinal axis of said roll of medium, whereby when said roll is placed on and supported by said belts, said roll is caused to rotate as the medium is withdrawn by said drive means.

2. A spray painting system as claimed in claim 1 including rotatable support means secured to said cradle frame for permitting movement of said cradle relative to said printer frame.

3. A spray painting system as claimed in claim 1 including a re-direct roller having a longitudinal axis for receiving medium from said roll and directing said medium toward said spray jets, and wherein a transverse center line of said belts is positioned laterally within about twelve inches of a vertical plane extending through the longitudinal axis of said re-direct roller.

4. A spray painting system as claimed in claim 3 wherein said vertical plane passes through said belts.

5. A spray painting system as claimed in claim 1 wherein said roll of medium is supported by at least three of said belts.

6. A spray painting system as claimed in claim 5 wherein the space between adjacent belts is between about 6 and 10 inches.

7. A spray painting system as claimed in claim 6 wherein said roll of medium is at least eight feet in length and including at least ten of said belts supporting said roll.

8. A spray painting system as claimed in claim 1 wherein said belts are formed of reinforced flexible material each prestretched to a common length prior to positioning on said cradle.

9. A spray painting system as claimed in claim 1 including positioning means secured to said printer frame for positioning said frame with respect to said cradle, stop means forming part of said cradle for intercepting said positioning means thereby to locate said cradle in a predetermined position relative to said printer frame, and means for locking said cradle in said predetermined position.

* * * * *